United States Patent [19]

Giesfeldt

[11] Patent Number: 4,738,772

[45] Date of Patent: Apr. 19, 1988

[54] PROCESS FOR SEPARATING FIBER FROM DRY-MILLED CORN

[75] Inventor: J. E. Todd Giesfeldt, LeGrange, Ill.

[73] Assignee: CPC International Inc., Englewood Cliffs, N.J.

[21] Appl. No.: 851,991

[22] Filed: Apr. 14, 1986

[51] Int. Cl.[4] ..... B03C 7/00

[52] U.S. Cl. ..... 209/2; 209/127.1; 209/128

[58] Field of Search ..... 209/1, 2, 12, 127.1–127.4, 209/128, 129, 183.1; 241/9; 426/481, 482, 483

[56] References Cited

U.S. PATENT DOCUMENTS

| | | | |
|---|---|---|---|
| 2,687,803 | 8/1954 | Johnson | 209/127.1 |
| 2,839,189 | 6/1958 | Johnson | 209/129 X |
| 3,059,772 | 10/1962 | Le Baron | 209/127.1 |
| 3,162,592 | 12/1964 | Pohl | 209/127.1 X |
| 3,256,985 | 6/1966 | Carpenter | 209/129 |
| 3,291,302 | 12/1966 | Brastad | 209/129 X |
| 4,229,486 | 10/1980 | Muller . | |
| 4,305,797 | 12/1981 | Knoll et al. | 209/129 X |
| 4,363,723 | 12/1982 | Knoll et al. | 209/128 |

FOREIGN PATENT DOCUMENTS

| | | | |
|---|---|---|---|
| 0680762 | 8/1979 | U.S.S.R. | 209/129 |

OTHER PUBLICATIONS

Product Bulletin 8370, "An Introduction to Electrostatic Separation", *Carpco, Inc.*, Jacksonville, Fla.

Information Sheet, "'Multi-Field' Electrostatic Separator", Carpco, Inc., Jacksonville, Fla.

*Primary Examiner*—Johnny D. Cherry

*Assistant Examiner*—Edward M. Wacyra

[57] ABSTRACT

A process for the separation of corn fiber from dry-milled corn. The corn fiber is separated frm the dry-milled corn by employing a Multified Electrostatic Separator using dielectrophoresis.

5 Claims, 1 Drawing Sheet

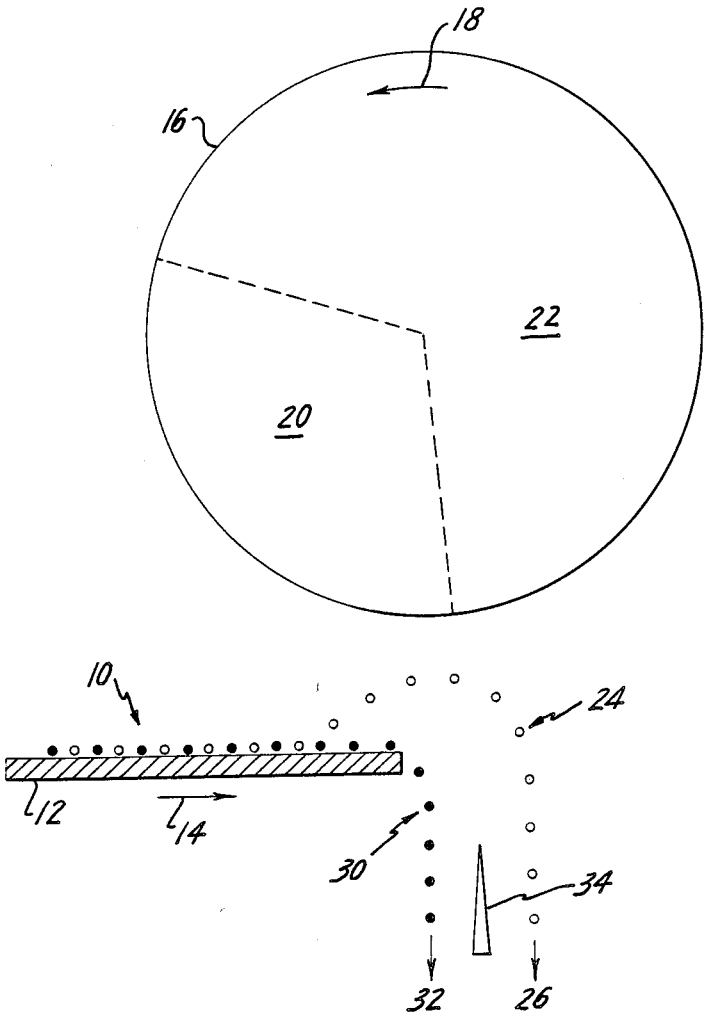
18
16
22
20
10
24
12
14
30
34
32
26

PROCESS FOR SEPARATING FIBER FROM DRY-MILLED CORN

FIELD OF THE INVENTION

This invention relates to improvements in the manufacture of dry-milled corn products. More particularly, this invention relates to improvements in the separation of the fiber from dry-milled corn by means of an electrostatic field.

BACKGROUND OF THE INVENTION

Corn milling processes are employed to separate corn into the various components of the corn kernel. Such processes are divided into two broad categories known as wet-milling processes and dry-milling processes. In the wet-milling processes, the corn is first steeped in an aqueous solution to soften the kernel. Dry-milling processes, on the other hand, use dry or slightly moistened grain which has not been subjected to the steeping operation.

The general purpose of corn dry-milling processes is to separate the corn kernel into germ, endosperm, and fiber fractions. These processes vary somewhat depending on the nature of the corn, the ratio of products desired, and various consumer preferences. Generally, the whole corn kernels are first cleaned to remove chaff and other extraneous material. The cleaned grain is then tempered with water or steam which tends to increase the water level in the various portions of the corn kernel. Next, the tempered grain is passed through a degerminating mill to release the fiber (hull) from the germ and endosperm.

In the usual corn dry-milling process, the discharge from the degerminating mill comprising corn fiber, germ, and endosperm is sifted into fractions according to particle size. The sifted fractions are subjected to a series of air aspiration steps to separate the fiber from the germ and endosperm. The mixture of germ and endosperm then undergoes further separation and purification treatments. As noted, the conventional dry-milling process requires aspirators to separate the fiber from the other components. The cost of this equipment, together with related air-handling equipment and dust collectors, add to the cost of this separation which also has a fairly high energy requirement.

BRIEF DESCRIPTION OF THE DRAWING

The single FIGURE of drawing is a schematic diagram showing one way in which equipment can be arranged to practice the process of the present invention.

SUMMARY OF THE INVENTION

It is an object of this invention to provide a new process for the separation of fiber from dry-milled corn which has a number of advantages over the methods previously used.

A further object of this invention is to provide a process which permits the elimination of aspirators and the associated dust collecting and air-handling equipment, thus resulting in a savings in equipment costs.

A still further object of this invention is to provide a unique electrostatic process for the separation of the corn fiber from the mixture of corn fiber, germ, and endosperm produced by the corn dry-milling process.

It has been found that the objects of this invention are realized by the process which is now generally described. According to this invention, there is provided a process for separating corn fiber from the mixture of corn fiber, germ, and endosperm produced by the dry milling of corn which comprises:

passing the mixture of corn fiber, germ, and endosperm through a nonuniform electric field;

attracting the corn fiber of said mixture away from the germ and endosperm by means of said nonuniform electric field;

directing the attracted corn fiber into one product stream; and directing the germ and endosperm into a separate product stream.

DETAILED DESCRIPTION OF THE INVENTION

In the practice of this invention, cleaned corn is tempered with sufficient water to give a total moisture of from about 19% to about 23% by weight. The tempered corn is then passed through a degerminating mill in order to release the fiber from the germ and endosperm. A suitable degerminating mill is the Buehler Mill, No. MHXG-30/95A, available from the Buehler-Miag Company, Uzwil, Switzerland. This mill and its operation is described in U.S. Pat. No. 4,229,486.

The mixture of corn fiber, germ, and endosperm is then separated into fractions of various sizes by means of sifters. One suitable sifter for this purpose is the Great Western TRU-BALANCE Sifter, available from the Great Western Manufacturing Company, Inc., Leavenworth, Kans.

Material passing through a No. 3.5 U.S. Standard Sieve and retained on a No. 28 U.S. Standard Sieve can be separated by the process of this invention. Fractions with narrower size ranges within this general size range may also be used. For example, material passing through a No. 3.5 U.S. Standard Sieve and retained on a No. 12 U.S. Standard Sieve can be separated by the present process. Material of suitable size range is subjected to separation by means of an electrostatic separator.

It has been discovered that electrostatic separators that generate a nonuniform electric field of sufficient intensity will attract corn fiber particles away from the corn germ and endosperm after the material is milled to the specified size range. Such separators are disclosed in U.S. Pat. Nos. 4,305,797 and 4,363,723. A particularly suitable separator is shown in the drawing.

It is noted that the process of this invention generally makes use of a dielectrophoresis apparatus. Such an apparatus is entirely different from an electrophoresis apparatus as disclosed in U.S. Pat. No. 2,687,803. In an electrophoresis apparatus, the material passes between highly charged electrodes, and there is frequently a corona discharge between electrodes. Such equipment is unsuitable for use with dry-milled corn because of the potential for sparking causing dust explosions.

The process of this invention is best understood by reference to the drawing. This drawing is a schematic view in elevation of one design of a Multifield Electrostatic Separator.

A thin layer of the mixture 10 of corn fiber, germ, and endosperm to be separated is placed on a feeder 12. The mixture 10 is moved continuously in the direction of the arrow 14. By this movement, mixture 10 is brought into an electric field emanating from rotating cylinder 16.

Cylinder 16 contains electrical conductors beneath the surface which are connected to a source of high voltage. As the cylinder rotates in the direction of arrow 18, the conductors have one charge when the surface of the cylinder is in close proximity to mixture 10, as shown in segmented zone 20. As cylinder 16 continues to rotate, the conductors entering zone 22 are given a charge opposite to that of the conductors in zone 20.

As mixture 10 is moved in direction 14, corn fiber particles 24 are attracted toward the cylinder by the nonuniform electrostatic field. They move in the direction of the rotation of the cylinder until they come near zone 22 where the charge of the cylinder is reversed. The corn fiber particles 24 are then repelled from the cylinder and dropped into corn fiber stream 26.

A mixture of corn germ and endosperm 30 is less attracted in the electrostatic field. As a result, it falls into separate product stream 32. A splitter 34 can be inserted between product streams 26 and 32 to aid in their separation.

In the practice of this invention, a thin layer of the mixture of corn fiber, germ, and endopserm is passed through the nonuniform electric field. Any feeder means for passing a thin layer of the mixture through the field can be used. Known means for this purpose include moving belts and vibrating feeders. A particularly useful feeder is one which provides a thin-fluidized bed of the mixture moving through the electric field.

The following examples illustrate certain embodiments of the present invention. Unless otherwise stated, all proportions and percentages are provided on the basis of weight.

Dent corn, U.S. No. 2 grade, was tempered with sufficient water to give a moisture content of 23%. The material was ground in the Buehler-Miag Decorticator, No. MHXG-30/95A. Grinding was carried out with a gate setting of approximately 15% open. The ground material was passed through a Model P/11×30 power sifter, available from the S. Howes Company, Inc., Silver Creek, N.Y., and through a plan sifter, the TRU-BALANCE Sifter. This produced fractions of various size ranges. The fiber was then removed from a given fraction by means of a CARPO® brand Multifield Electrostatic Separator.

Separations were performed using a laboratory size Multifield Electrostatic Separator, available from Carpco, Inc., Jacksonville, Fla. Its general arrangement is shown schematically in the drawing. Feeder tray 12 was positioned 1.5 inches below the bottom of cylinder 16. Best separations were obtained when the separator was operated at between about 10 kilovolts (kv) and 30 kv. There was a gap of about 1.25 inches between the discharge end of feeder tray 12 and a line which passed vertically through the center of cylinder 16. The supply flow rate of the material was adjusted to give a good visual split between the ground corn and the free fiber. The cylinder was rotated at 75 revolutions per minute and the supply rate was between 30 and 80 lb/hr/in. of feed tray width. Four to five passes through the apparatus were sufficient to give a separation of nearly all of the free fiber from the ground corn. The ground corn residues resulting from this separation contained on the average 5 or fewer pieces of free fiber per 50-gram sample.

Representative results of runs made to separate fiber from various fractions of the undried ground corn are given in the table. They show that corn fiber can be separated from dry-milled corn by means of a Multifield Electrostatic Separator and that the starch content of this fiber is comparable to that of the corn fiber obtained by more-expensive prior art processes.

ELECTROSTATIC SEPARATION OF DRY-MILLED CORN

| Run No. | Supply Size (U.S. Std. Sieve) | Supply Moisture (%) | Fiber Stream (% of Supply, Dry Basis) | Starch in Fiber Stream (% Dry Basis) |
|---|---|---|---|---|
| 1[a] | −3.5 to +28 | 22.7 | 5.3 | 35.4 |
| 2[b] | −3.5 to +12 | 22.5 | 4.4 | 30.5 |
| 3[c] | −12 to +28 | 29.1 | 3.9 | 27.8 |

[a]Five passes through separator at 25 kv.
[b]Four passes through separator at 25 kv.
[c]Five passes through separator at 11-15 kv.

Some separations were run on material that had been dried to 10–12% moisture. These gave less satisfactory fiber separation and the rate of separation was much slower than that obtained using material having a moisture content between about 20% and 30% by weight. Thus, an additional advantage of the present process is the elimination of a costly drying step.

Thus, it is apparent that there has been provided, in accordance with the invention, a process for the separation of fiber from ground corn that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to include all such alternatives, modifications, and variations as set forth within the spirit and scope of the appended claims.

What is claimed is:

1. A process for separating corn fiber from the mixture of corn fiber, germ, and endosperm produced by the dry milling of corn which comprises:

passing the mixture of corn fiber, germ, and endosperm, having a moisture content of between about 20% and about 30% by weight, through a nonuniform electric field;

attracting the corn fiber of said mixture away from the germ and endosperm by means of said nonuniform electric field;

directing the attracted corn fiber into one product stream; and directing the germ and endosperm into a separate product stream.

2. The process of claim 1 wherein the mixture of corn fiber, germ, and endosperm is of such a size that it will pass through a 3.5 U.S. Standard Sieve and will be retained on a No. 28 U.S. Standard Sieve.

3. The process of claim 1 wherein the nonuniform electric field is generated by a Multifield Electrostatic Separator operating by means of dielectrophoresis.

4. The process of claim 3 wherein the Multifield Electrostatic Separator is operated at a voltage between about 10 kilovolts and about 30 kilovolts.

5. The process of claim 1 wherein the mixture of corn fiber, germ, and endosperm is passed through the nonuniform electric field by means of a moving fluidized bed.

* * * * *